United States Patent [19]

Herrington et al.

[11] Patent Number: 5,063,644

[45] Date of Patent: Nov. 12, 1991

[54] FOLDABLE ZIPPER SLIDER WITH COMPRESSION-TYPE LATCH

[75] Inventors: F. John Herrington, Holcomb; Eric A. St. Phillips, Fairport, both of N.Y.

[73] Assignee: Mobil Oil Corporation, Fairfax, Va.

[21] Appl. No.: 673,711

[22] Filed: Mar. 22, 1991

[51] Int. Cl.[5] ..... A44B 19/16

[52] U.S. Cl. ..... 24/400; 24/399; 24/587

[58] Field of Search ..... 24/400, 399, 587, 576; 383/63, 65; 156/66

[56] References Cited

U.S. PATENT DOCUMENTS

| | | | |
|---|---|---|---|
| 2,869,207 | 1/1959 | Dernstein | 24/400 |
| 3,103,049 | 9/1963 | Hawley | 24/400 |
| 3,122,807 | 3/1964 | Ausnit | 24/399 |
| 3,220,076 | 11/1965 | Ausnit et al. . | |
| 3,347,298 | 10/1967 | Ausnit et al. | 150/3 |
| 3,426,396 | 2/1969 | Laguerre . | |
| 3,462,332 | 8/1969 | Goto | 156/244 |
| 3,579,747 | 5/1971 | Hawley | 24/400 |
| 3,660,875 | 5/1972 | Gutman . | |
| 3,713,923 | 1/1972 | Laguerre | 156/66 |
| 3,790,992 | 2/1974 | Herz . | |
| 3,806,998 | 4/1974 | Laguerre . | |
| 4,262,395 | 4/1981 | Kosky . | |
| 4,517,710 | 5/1985 | Beckmann | 24/297 |
| 4,736,451 | 4/1988 | Ausnit . | |
| 5,007,142 | 4/1991 | Herrington | 24/400 |
| 5,007,143 | 4/1991 | Herrington | 24/400 |
| 5,010,627 | 4/1991 | Herrington et al. | 24/400 |

FOREIGN PATENT DOCUMENTS

| | | |
|---|---|---|
| 1109532 | 1/1956 | France . |
| 375235 | 1/1940 | Italy . |
| 914203 | 12/1962 | United Kingdom . |
| 914204 | 12/1962 | United Kingdom . |
| 1139838 | 1/1969 | United Kingdom . |

*Primary Examiner*—Victor N. Sakran

*Attorney, Agent, or Firm*—Alexander J. McKillop; Charles J. Speciale

[57] ABSTRACT

A one-piece foldable plastic zipper slider for straddling relation with a profiled plastic reclosable fastener. The plastic zipper slider has hinged wings that are latched in place by a latch tongue which is deflected downward to snap in place and then cannot be re-opened because subsequent forces act in such a direction to engage it more strongly.

6 Claims, 3 Drawing Sheets

FIG. 3
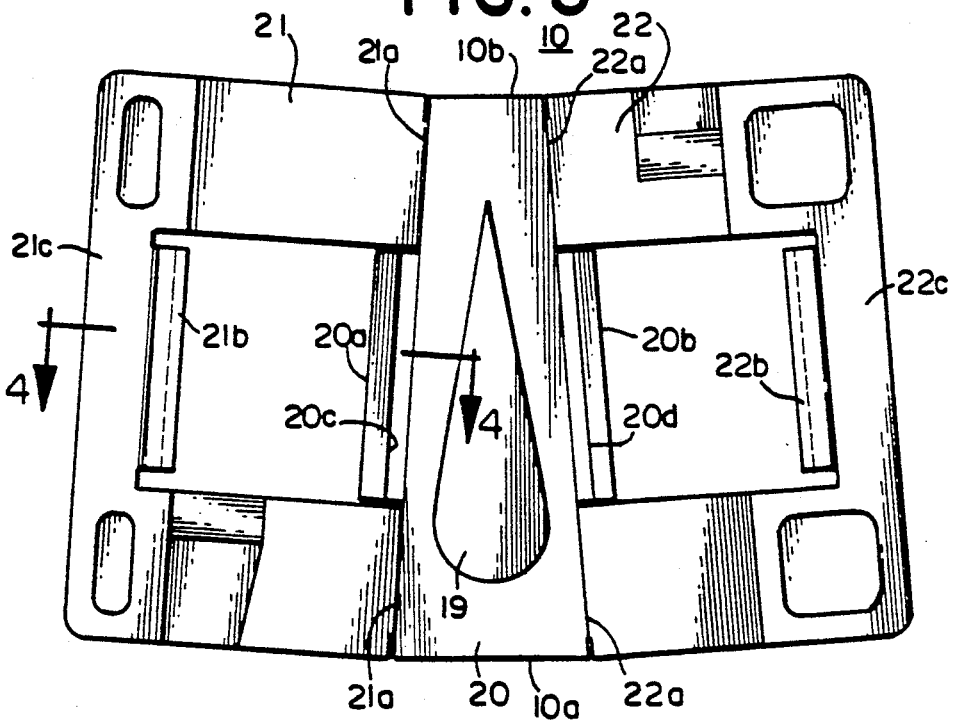
FIG. 4a
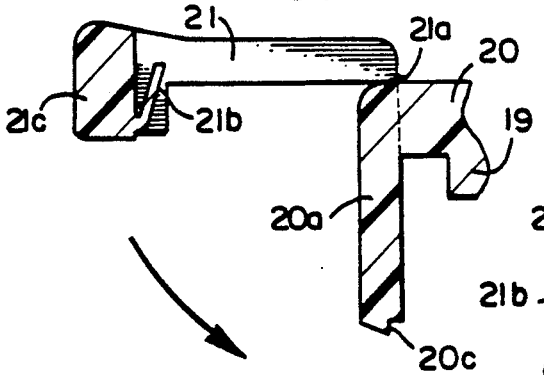
FIG. 4b
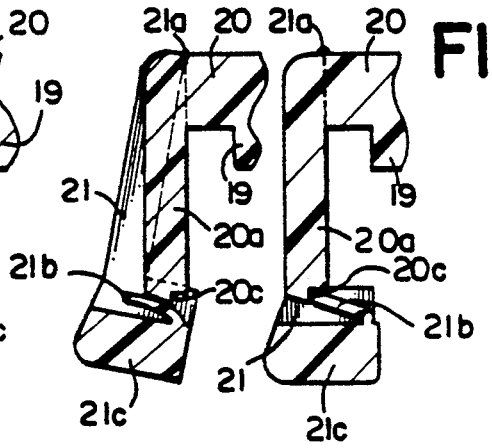
FIG. 4c

FOLDABLE ZIPPER SLIDER WITH COMPRESSION-TYPE LATCH

BACKGROUND OF THE INVENTION

The present invention relates to improvements in plastic sliders for opening and closing plastic reclosable fasteners on plastic bags and the like and particularly to improvements in one-piece "gull wing" type foldable plastic sliders for profiled plastic reclosable fasteners on plastic bags.

Plastic zippers with sliders are well known in the art. The plastic zippers have profiles and include a pair of male and female fastener elements in the form of reclosable interlocking rib and groove elements with a slider for opening and closing the rib and groove elements. In the manufacture of thermoplastic film bags, a pair of these male and female fastener elements extend along the mouth of the bags and these male and female elements are adapted to be secured in any suitable manner to the flexible walls of the thermoplastic film bag. These elements may be integral marginal portions of such walls or they may be extruded separately and thereafter attached to the walls along the mouth of the bag. A method of continuously providing such a fastener on the thermoplastic film is disclosed in U.S. Pat. No. 3,462,332.

The sliders for opening or closing the reclosable fasteners are essentially U-shaped and adapted to be assembled with the fastener or zipper by an endwise assembly or by a relative transverse maneuver. In some instances the sliders are formed of multiple parts and assembled on the zipper. The assembly may be simplified if the slider is formed of one part and the sides are foldable into position when assembled on the zipper. Examples of foldable plastic sliders are disclosed in the related applications referred to below.

RELATED APPLICATIONS

The present invention is an improvement on the foldable plastic slider disclosed in the related application of F. J. Herrington entitled "Gull Wing Zipper Slider" Ser. No. 490,106 filed Mar. 7, 1990 and in the related application of F. J. Herrington and A. Goncarovs entitled "Foldable Plastic Slider and Method of Assembly with a Plastic Reclosable Fastener" Ser. No. 409,108 filed Mar. 7, 1990 and incorporated herein by reference thereto. Another plastic zipper and slider is disclosed in the related application of F. J. Herrington entitled "Rolling Action Zipper Profile and Slider Therefor" Ser. No. 490,110 filed Mar. 7, 1990 and incorporated herein by reference thereto. All of the above-identified related applications are assigned to the same assignee as the present application.

SUMMARY OF THE INVENTION

It is an object of the present invention to provide a new and improved one-piece foldable plastic zipper slider with compression-type latch.

The present invention relates to a foldable plastic slider for straddling relation with a profiled plastic reclosable fastener particularly suited for thermoplastic bags and the like formed by a pair of flexible plastic sheets having a top edge with separable fastener means extending along the length thereof comprising reclosable interlocking male and female elements having rib and groove profiles on the respective sheets. The straddling slider for closing or opening the reclosable fastener elements comprises a separator finger and interlocking complimentary structure formed from plastic for moving along the fastener. The complimentary structure comprises a transfer support member having the separator finger depending therefrom, a pair of legs depending from the support member on opposite sides of the support member and on opposite sides of the finger and a pair of sidewalls hinged to the opposite sides of the support member at the top thereof and on opposite sides of the respective legs. The side walls are foldable relative to the separator finger and have openings therein for receiving the depending legs. Means is provided for interlocking the sidewalls to the depending legs comprising shoulder structure extending along an edge of each of the depending legs and flexible tongue structure extending along a corresponding edge in each of the sidewalls. The flexible tongue structure is depressible by the edge of the depending legs and is adapted to snap into engagement with the respective shoulders on the legs to provide a compression-type latch for locking the sidewalls in their folded position. The sidewalls extend from an opening end of the slider to the closing end, the sidewalls being spaced wider apart at the opening end to permit separation of the rib and groove elements by the separator finger extending between the sidewalls at the opening end. The sidewalls are spaced sufficiently close together at the closing end to press the rib and groove elements into interlocking relationship as the slider is moved in a faster closing direction, the sidewalls having shoulder structure on the bottom thereof for cooperating with the bottom of the fastener to prevent the slider from being lifted off the top edge of the fastener while the slider straddles the fastener.

BRIEF DESCRIPTION OF THE DRAWINGS

FIG. 3 is a bottom plan view of the foldable plastic slider shown in FIG. 1.

FIG. 4*a* is a sectional view taken along the lines 4—4 in FIG. 3.

FIG. 4*b* is a sectional view similar to FIG. 4*a* with the foldable wing rotated downwardly into a partially assembled position.

FIG. 4*c* is a sectional view similar to FIGS. 4*a* and 4*b* with the foldable wing fully rotated to the assembled position with the compression-type latch snapped closed.

PREFERRED EMBODIMENT OF THE INVENTION

Figure 1:
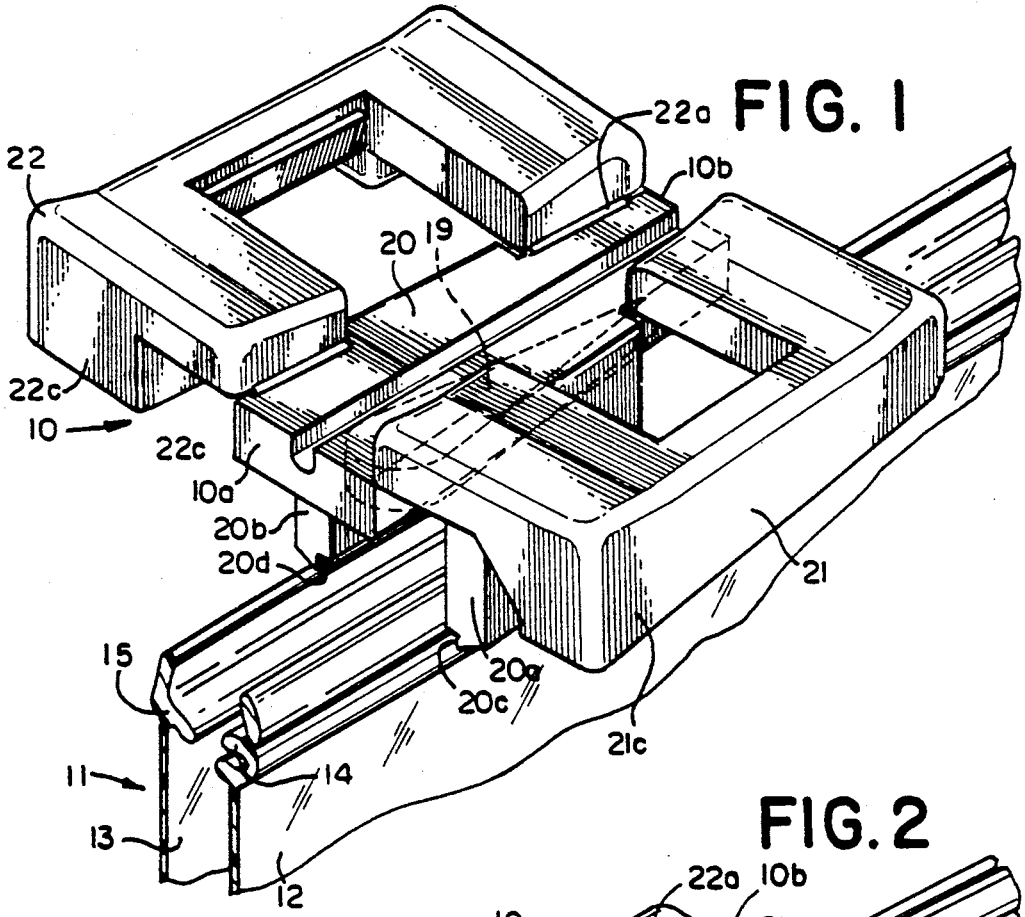
FIG. 1 is a perspective view of a foldable plastic slider embodying the present invention shown in open position and illustrating the method of assembling the foldable plastic slider with a profiled plastic reclosable fastener in accordance with the present invention.

Referring to FIG. 1, there is illustrated a foldable plastic slider 10 for a profile plastic reclosable fastener embodying the present invention. The slider 10 is particularly suited for thermoplastic bags and the like and has been illustrated in FIG. 1 in connection with a thermoplastic bag 11. The bag 11 is of conventional type and may be made from any suitable thermoplastic film such for example as polyethylene, polypropylene or equivalent material. The bag 11 is formed by a pair of flexible plastic sheets 12 and 13 having a top edge with separable fastener means at the top edge extending along the length thereof, having reclosable interlocking rib and groove profile elements 15 and 14 on the facing surfaces thereof. In the manufacture of thermoplastic film bags, a pair of male and female fastener elements 15 and 14 extend along the mouth of the bag and these (interlocking rib and groove profiles) elements are adapted to be secured in any suitable manner to the flexible walls of the thermoplastic film bags. These elements may be integral marginal portions of such walls or they may be extruded separately and thereafter attach the walls along the mouth of the bag as well known in the art. The elements 15 and 14 are attached to the respective walls of the bags on opposite sides of the bags as disclosed in FIGS. 1, 2 and 5–9. The cross-sectional shapes of the interlocking male and female elements having the rib and groove profiles 15 and 14 are the subject of my invention claimed in the aforesaid related application entitled "Rolling Action Zipper Profile and Slider Therefor" Ser. No. 490,110. The manner of attaching the elements 14, 15 to the respective walls of the bag is well known in the art and does not form part of the present invention.

Figure 2:
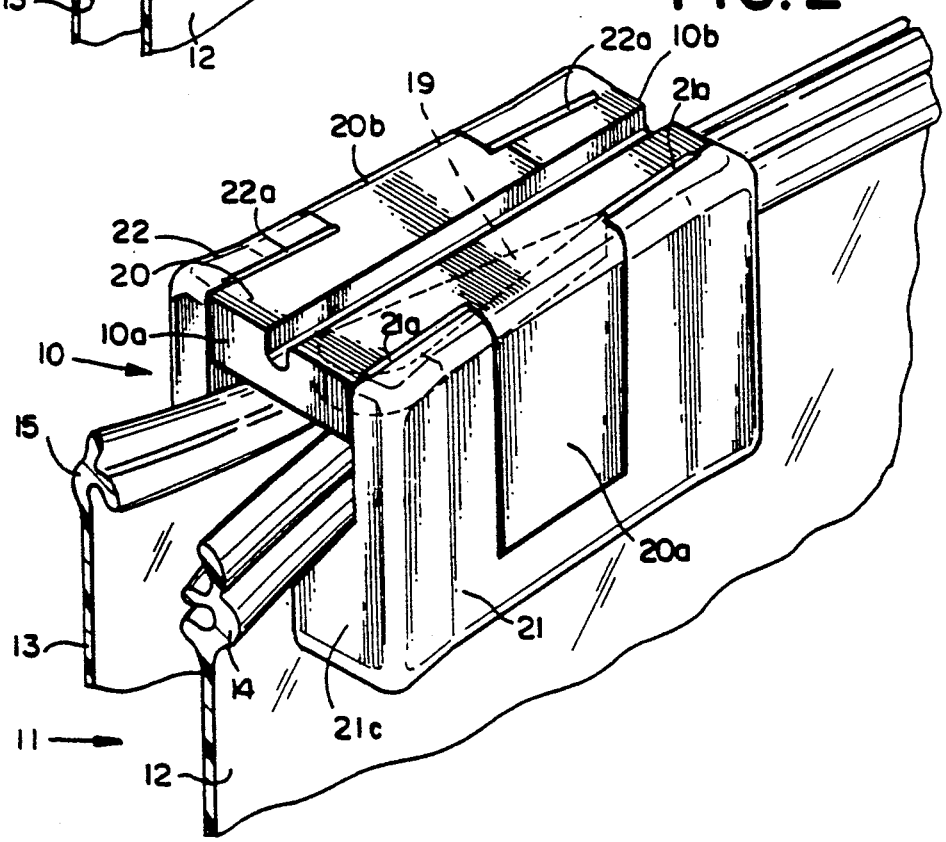
FIG. 2 is a perspective view of the foldable plastic slider of FIG. 1 assembled on the profiled plastic reclosable fastener with the foldable wings of the slider snapped into closed position.
Figure 5:
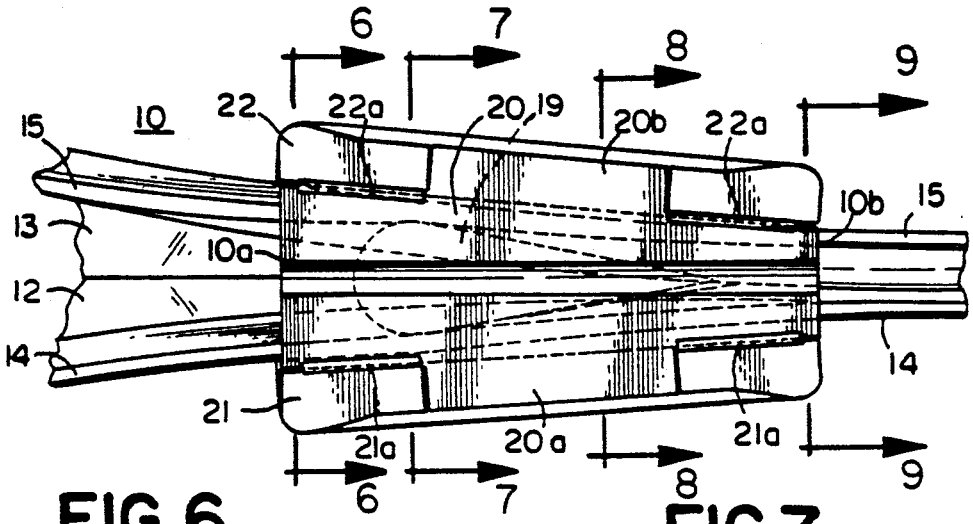
FIG. 5 is a top plan view of the slider shown in FIG. 2.

As may be seen in FIGS. 1, 2 and 5 the slider 10 straddles the reclosable fastener elements 14 and 15 at the top of the bag 11 and is adapted for opening or closing the reclosable fastener elements. The novel slider 10 is formed from a single piece of molded plastic comprising a separator finger 19 and interlocking complimentary structure for moving along the fastener. The separator finger 19 is wider at one end to aid in opening the fastener elements 14 and 15 and thus may be referred to as "wedge-shaped". The slider 10 may be molded from any suitable plastic such for example as nylon, polypropylene, polystyrene, Delrin or ABS. In the preferred embodiment the complimentary structure comprises an inverted U-shaped member including a transverse support member or body 20 from which the separator finger 19 depends. The body 20 is itself U-shaped and includes two integral depending legs **20*a*, 20*b*. The finger 19 is position between the legs 20*a*, 20*b*. The body 20 is adapted to move along the top edges of the fastener elements 14 and 15 with the legs 20*a*, 20*b* straddling these elements and the finger 19 positioned between the elements 14 and 15. The body 20 also includes a pair of hinged "wings" or side walls 21 and 22 that can be folded down into their final position. The wings 21 and 22 are hinged to the main slider body 20 by means of hinge structure 21*a* and 22*a* located at the opposite ends of the legs 20*a* and 20*b*. It will be noted that the wings 21 and 22 have central openings into which the legs 20*a*, 20*b* extend when the wings 21 and 22 are folded down into their final position as hereinafter to be described. It will be noted that the hinge structure 21*a* and 22*a* is located on the opposite sides of the main slider body 20 at the top thereof. When the wings 21 and 22 are folded down from the position in FIG. 1 to the position in FIG. 2 the wings 21 and 22 engage the opposite edges of the body 20. The hinge structure 21*a* and 22*a* is a relatively thin section of the plastic material as compared to the wall thicknesses of the wings 21 and 22 and the flexibility of the plastic material makes possible the use of the integral hinge structure 21*a* and 22*a*** which is sometimes referred to as a "living" hinge.

When the wings 21 and 22 are folded down to their final side wall position from the wing position shown in FIG. 1, to the side wall position shown in FIG. 2, the side walls 21 and 22 are held in fixed position by a novel compression-type slider latch as now to be described. As may be seen in FIGS. 3 and **4*a*–4*c* the wing 21 is provided adjacent its outer end with a flexible tongue 21*b*. The lower end of the leg 20*a* is provided with an angled surface adjacent a latching shoulder 20*c*. When the wing 21 is rotated in a counter clockwise direction as illustrated by the arrow in FIG. 4*a* the flexible tongue 21*b* will be deflected downward by the angled surface on the lower end of the leg 20*a* as illustrated in FIG. 4*b* and when the wing 21 is in the vertical position as shown in FIG. 4*c* the flexible tongue 21*b* will have snapped in place and moved into engagement with the shoulder 20*c* at the lower end of leg 20*a*. When the wing 21 has moved from the position in FIG. 4*a* to the position shown in FIG. 4*c*, the compression-type latch comprising the tongue 21*b* and the shoulder 20*c* will be in locked position. Once the latch has been engaged it cannot be disengaged without breaking it. As it is being latched the tongue 21*b* deflects downward as shown. However, when attempting to disengage it, the direction in which the force acts on it exerts a component to force it more strongly into engagement. It is to be understood that the other wing 22 likewise has a flexible tongue 22*b* which is adapted to engage a shoulder 20*d* at the lower end of the leg 20*b* so as to provide a compression-type latch and lock the wing 22** in place.

Thus it will be seen that when the flexible wings 21 and 22 have been moved from the open position shown in FIG. 1 to the lower or locked positions shown in FIG. 2, the wings will be in their downward position with the compression-type latching structure snapped in place, capturing the zipper tracks 14 and 15 so that the slider 10 cannot be removed from the zipper after the wings are snapped in place. It will be noted that the latch structure comprising the flexible tongues **21*b*, 22*b* and their cooperating shoulders 20*c* and 20*d* are particularly effective in locking the foldable wings 21 and 22 in the downward position. This is due to the fact that the tongues 21*b* and 22*b* are a relatively long distance from their respective pivots 21*a* and 22*a*. With this arrangement, the latch acts at a maximum distance from the hinge giving the best mechanical advantage. It will also be noted that with this latching arrangement there is still retained the benefit of being able to mold this slider 10** in a simple two-piece mold and thus reduce the cost of manufacture of the slider.

As may be seen in FIGS. 5–9 the foldable depending side walls 21 and 22 extend from an opening end **10*a* of the slider 10 to a closing end 10*b*. It will also be noted that the main slider body 20 and the separator finger 19 are wider at the opening end 10*a* then at the closing end 10*b*. Similarly the side walls 21 and 22 and the depending legs 20*a* and 20*b* are spaced wider apart at the opening end 10*a* of the slider 10, FIGS. 5 and 6, to permit separation of the rib and groove elements 15 and 14 by the finger 19 and are spaced sufficiently close together at the closing end 10***b* of the slider, FIG. 9, to press the rib and groove elements 14 and 15 into interlocking relationship as the slider 10 is moved in a fastener closing direction. The side walls 21 and 22 at their lower ends are provided with inwardly extending shoulder structure 21*c* and 22*c*, FIGS. 6–9, for engaging the bottom of the fastener comprising the rib and groove elements 15 and 14 to prevent slider 10 from being lifted off the top edges of the fastener while the slider straddles the fastener as shown in FIGS. 2 and 5.

Figure 6:
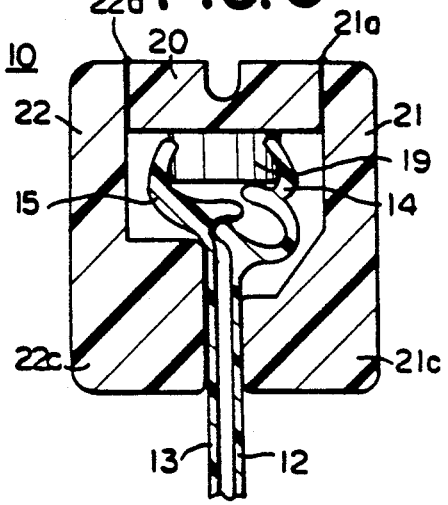
FIG. 6 is a sectional view taken along the lines 6—6 in FIG. 5.
Figure 7:
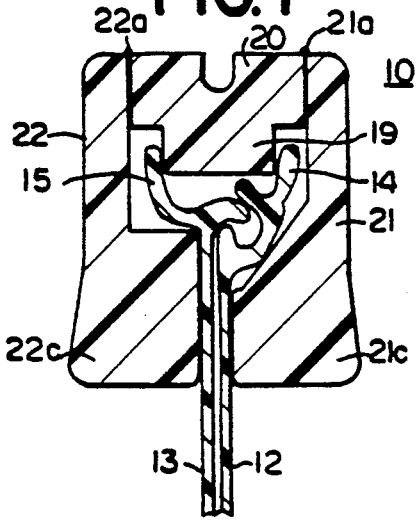
FIG. 7 is a sectional view taken along the lines 7—7 in FIG. 5.

The depending plastic separator finger 19 which extends between the side walls 21 and 22 and the depending legs 20*a* and 20*b* is wider adjacent the opening end 10*a* of the slider 10 for separating the rib and groove elements 15 and 14 as the slider 10 is moved in the fastener opening direction, FIGS. 5–7.

Figure 8:
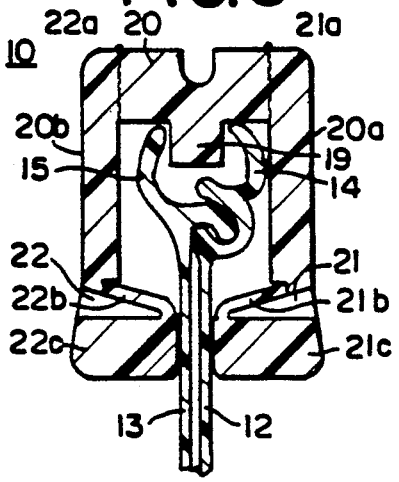
FIG. 8 is a sectional view taken along the lines 8—8 in FIG. 5.
Figure 9:
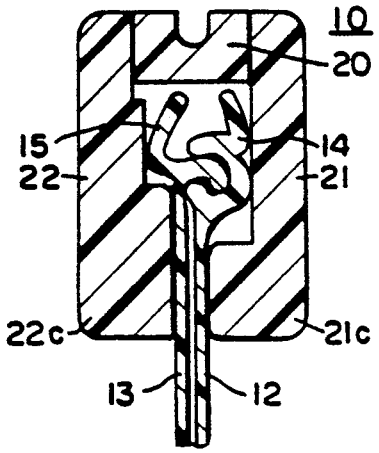
FIG. 9 is a sectional view taken along the lines 9—9 in FIG. 5.

Referring to FIGS. 1 and 2 there is illustrated the method of assembly of the foldable plastic slider 10 with the profiled plastic reclosable fastener of a thermoplastic bag formed by the pair of flexible plastic sheets 12 and 13 having a top edge with a separable fastener means at the top edge extending along the length thereof, having reclosable interlocking rib and groove profile elements 15 and 14 on the facing surfaces thereof. The interlocking rib and groove profile elements 15 and 14 on the facing surfaces are placed in alignment so that they can be joined as indicated at the right hand end of FIGS. 2 and 5. The foldable slider 10 with the wings 21 and 22 in the open position, FIG. 1, is positioned above the profile elements 14 and 15 as shown in FIG. 1. When the elements 14 and 15 are joined as indicated at the right hand end of FIG. 5, the depending finger 19 is inserted between the top edges of the elements 14 and 15 as shown in FIG. 6. The depending legs 20*a* and 20*b* are positioned on the outer sides of the profile elements 14 and 15 as shown in FIGS. 5 and 8. The body 20 of the slider 10 then rests on the top of the elements 14 and 15. The wings 21 and 22 are then folded down as indicated by the arrow in FIG. 4*a* at the hinged structure 21*a* and 22*a* located at the top of the slider body 20 so that the wings 21 and 22 are in their folded side wall position against the edges of the slider body 20 as shown in FIG. 2. When the side walls 21 and 22 are moved to the folded position shown in FIG. 2 the compression-type latching mechanism comprising the flexible tongues 21*b*, 22*b* will have been compressed and snapped into locked position with the corresponding shoulders 20*c*, 20*d*, FIG. 8. Thus when the compression-type latching mechanism is locked in position as shown in FIG. 8 the side walls 21 and 22 are prevented from being rotated upwardly around the hinge structure 21*a* and 22*a*. In this assembled position the shoulders 21*c* and 22*c* on the side walls 21 and 22 are positioned beneath the bottom of the fastener elements 14 and 15 FIGS. 6–9, to prevent the slider 10 from being lifted off the top edges of the fastener.

Since the side walls 21 and 22 of the foldable slider 10 are integral with the body portion 20, this provides for ease in assembly as distinguished from multiple part sliders. It also provides for ease in manufacturing and molding as pointed out above. By providing the compression-type latch structure at a maximum distance from the hinge structure 21*a* and 22*a* there is assured a tight locking of the wings 21 and 22 when they are moved to their closed downward position as shown in FIG. 2. This compression-type latch mechanism insures that the foldable wings 21 and 22 will not be accidentally unlatched so that the slider 10 could become detached from the zipper structure 14, 15. Also since the slider is made from plastic material it can be used on a food bag in a microwave whereas a metal slider cannot. While a preferred form of the invention has been described in connection with a living hinge, other plastics which are not suitable for making a living hinge can be used. Thus more brittle plastics can be used. It is only necessary that the side walls be folded down once and latched in place by the compression-type latch since the slider is not removed from the reclosable fastener elements once it is assembled.

While a preferred embodiment of the invention has been described and illustrated in connection with the interlocking rib and groove profiles of the shaped disclosed in the aforesaid related application Serial No. 490,110, it is to be understood that the novel foldable plastic slider of the present invention is also applicable to profiled plastic reclosable fasteners or zippers of the conventional configuration as shown in U.S. Pat. No. 3,660,875 and in the related applications Ser. Nos. 490,109 and 490,107. In conventional profiled plastic zippers, the separator tab or finger is inserted directly between the rib and groove portions of the interlocking elements rather than above the rib and groove portions as disclosed herein.

While a preferred embodiment of the invention have been described and illustrated, it is to be understood that further modifications thereof may be made within the scope of the appended claims without departing from the spirit of the invention.

What is claimed is:

1. A foldable plastic slider for straddling relation with a profiled plastic reclosable fastener comprising reclosable interlocking male and female elements, the straddling slider for closing or opening the reclosable fastener elements comprising a separator finger and interlocking complementary structure formed from plastic for moving along the fastener, the complementary structure comprising a transverse support member having said separator finger depending therefrom, a pair of legs depending from said support member on opposite sides of said support member and on opposite sides of said finger, a pair of side walls hinged to the opposite sides of said support member on opposite sides of the respective legs, said side walls being foldable relative to said separator finger and having openings therein for receiving said depending legs, and means for interlocking said side walls to said depending legs comprising shoulder structure extending along an edge of each of said depending legs and flexible tongue structure extending along a corresponding edge in each of said side walls, said flexible tongue structure being depressible by the edge of said depending legs and adapted to snap into engagement with the respective shoulders on said legs to provide a compression-type latch for locking said side walls in their folded position.

2. A foldable plastic slider according to claim 1 wherein said pair of sidewalls are hinged to the opposite sides of said support member at the top thereof, said sidewalls being folded against the opposite sides of said support member when in their folded position.

3. A foldable plastic slider according to claim 1 wherein said sidewalls have shoulder structure on the bottom thereof for cooperating with the bottom of the fastener to prevent the slider from being lifted off the fastener while the slider straddles the fastener.

4. A foldable plastic slider according to claim 1 wherein said separator finger is wedge-shaped and said sidewalls extend from an opening end of the slider to the closing end, the sidewalls being spaced wider apart at the opening end to permit separation of the male and female elements by the wedge-shaped separator finger extending between the sidewalls at the opening end, the sidewalls being spaced sufficiently close together at the closing end to press the male and female elements into interlocking relationship as the slider is moved in a fastener closing direction.

5. A foldable plastic slider according to claim 1 wherein said shoulder structure extends along the lower end of each of said depending legs, and said flexible tongue structure extends along the lower end of the openings in each of said side walls and is depressible by the lower ends of said depending legs.

6. A foldable plastic slider for straddling relation with a profiled plastic reclosable fastener particularly suited for thermoplastic bags and the like formed by a pair of flexible plastic sheets having a top edge with separable fastener means extending along the length thereof comprising reclosable interlocking male and female elements having rib and groove profiles on the respective sheets, the straddling slider for closing or opening the reclosable fastener elements comprising a separator finger and interlocking complementary structure formed from plastic for moving along the fastener, the complementary structure comprising a transverse support member having said separator finger depending therefrom, a pair of legs depending from said support member on opposite sides of said support member and on opposite sides of said finger, a pair of side walls hinged to the opposite sides of said support member at the top thereof and on opposite sides of the respective legs, said side walls being foldable relative to said separator finger and having openings therein for receiving said depending legs, and means for interlocking said side walls to said depending legs comprising shoulder structure extending along the an edge of each of said depending legs and flexible tongue structure extending along a corresponding edge in each of said side walls, said flexible tongue structure being depressible by the edge of said depending legs and adapted to snap into engagement with the respective shoulders on said legs to provide a compression-type latch for locking said side walls in their folded position, said side walls extending from an opening end of the slider to the closing end, the side walls being spaced wider apart at the opening end to permit separation of the rib and groove elements by the separator finger extending between the side walls at the opening end, the side walls being spaced sufficiently close together at the closing end to press the rib and groove elements into interlocking relationship as the slider is moved in a fastener closing direction, at least one of said side walls having shoulder structure on the bottom thereof for cooperating with the bottom of the fastener to prevent the slider from being lifted off the top edge of the fastener while the slider straddles the fastener.

* * * * *